US006196362B1

(12) United States Patent
Daugherty, Jr. et al.

(10) Patent No.: US 6,196,362 B1
(45) Date of Patent: Mar. 6, 2001

(54) LOCK BOLT WITH MODIFIED END CAP FOR SLACK ADJUSTER

(75) Inventors: David W. Daugherty, Jr., Plainfield; Michael J. Moriarity, Lansing; Wajih Kanjo, Lockport, all of IL (US)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/311,761

(22) Filed: May 13, 1999

(51) Int. Cl.[7] ..... F16D 65/52
(52) U.S. Cl. ..... 188/197; 188/202
(58) Field of Search ..... 188/196 R, 197, 188/198, 199, 200, 201, 202, 203, 196 F, 196 M, 196 P, 196 BA, 196 D, 196 V, 300, 67

(56) References Cited

U.S. PATENT DOCUMENTS 4,593,797 6/1986 Schmitt ..... 188/196 D
4,646,882 3/1987 Holloway et al. ..... 188/202
4,662,485 5/1987 Kanjo et al. ..... 188/196 D
4,809,820 3/1989 Smith ..... 188/196 M

*Primary Examiner*—Douglas C. Butler
*Assistant Examiner*—Pamela J. Rodriguez
(74) *Attorney, Agent, or Firm*—James Ray & Associates

(57) ABSTRACT

A locking assembly for preventing the accidental let out of a slack adjuster is provided. The elongated rod member of the slack adjuster has a first portion positioned within at least a portion of the slack adjuster's elongated hollow housing member and a second portion extending out of an end of this elongated hollow housing. A jaw member may be provided which is engageable with this second portion of the elongated rod member at a location remote from the end of the elongated hollow housing member. The locking assembly comprises an end cap engageable with the end of the elongated hollow housing. This end cap includes a portion extending substantially parallel with the second portion of the elongated rod member. At least one aperture is formed through this parallely extending portion of the end cap. A member is provided which is engageable within this at least one aperture and with the second portion of the elongated rod member or the jaw member for preventing longitudinal movement of the elongated rod member with respect to the elongated hollow housing member and consequently for preventing the accidental let out of the slack adjuster.

20 Claims, 7 Drawing Sheets

LOCK BOLT WITH MODIFIED END CAP FOR SLACK ADJUSTER

FIELD OF THE INVENTION

The present invention relates, in general, to slack adjuster assemblies which automatically adjust the slack in the brake rigging of a railway vehicle and, more particularly, the invention relates to a locking assembly for preventing the accidental let out of the slack adjuster and turning of the jaw member during shipping and handling.

BACKGROUND OF THE INVENTION

Slack adjusters are well known components which are provided in the brake rigging of railway vehicles to automatically adjust the slack in such brake rigging for a number of reasons. One such reason is that the slack adjuster automatically maintains the brake cylinder piston rod travel within a preselected travel distance. Maintaining such brake cylinder piston rod travel distance within the prescribed limit is of particular importance in present day higher speed train operations. Another important reason is that the slack adjusters will provide a substantially more uniform braking force to be applied to each set of wheels on each car making up a train. Because of the improvement in providing a more uniform braking force, the undesirable possibility of some cars in the train being held back while other cars roll ahead is generally minimized. A third reason is that in a truck-mounted braking system, a slack adjuster may be used to replace one of the brake cylinders of the brake rigging resulting in considerable cost reduction and weight savings.

A double-acting compression actuatable slack adjuster to adjust the slack in a railway vehicle brake rigging, as shown in FIG. 1, typically includes an elongated hollow housing member connectable at a first end thereof to a brake rigging, an elongated rod member which is also connectable at a first end thereof to such brake rigging and has a threaded portion at least adjacent a second end thereof. This threaded portion of the rod member extends into and is reciprocally movable within the housing through a second end of the housing. A movable positioning means is threadedly engaged with the threaded portion of the rod member intermediate the ends thereof. This positioning means rotates about the threaded portion of the rod member when in the disengaged position thereby changing the length of the slack adjuster assembly by changing the relative longitudinal position between the housing and the rod member. A pair of abutment surfaces, a pair of urging means, and an overtravel control system are provided for controlling the movement of this positioning means in response to the travel distance of a brake cylinder piston connected to the brake rigging.

When properly installed in the brake rigging, the slack adjuster will maintain specified piston travel at all times. The unit will automatically lengthen on one of the release and application of a brake to adjust for brake shoe wear. When worn shoes are replaced, the unit can be shortened to provide proper piston travel on the forward stroke of the first brake application.

A slack adjuster must be carefully packaged to avoid accidental let out of the slack adjuster and turning of the jaw member during shipping and handling. Either of these occurrences could lead to difficulty during installation of the slack adjuster in the brake rigging.

SUMMARY OF THE INVENTION

An object of the present invention is to provide a means for preventing the accidental let out of a slack adjuster during shipping and handling.

Another object of the present invention is to provide a means for preventing the turning of the jaw member of a slack adjuster during shipping and handling.

A further object of the present invention is to provide a means for maintaining a slack adjuster at a proper length and for ensuring the proper position of the jaw member during installation of the slack adjuster into the brake rigging of a railway vehicle.

Still yet a further object of the present invention is to provide a locking means for preventing the accidental let out and/or the turning of a jaw member of a slack adjuster during shipping, handling, and/or installation.

Another object of the present invention is to provide a locking means which may be quickly and easily disengaged upon installation of the slack adjuster in the brake rigging of the railway vehicle.

Briefly, and in accordance with the foregoing objects, the instant invention comprises a locking assembly for preventing the accidental let out of a slack adjuster wherein the slack adjuster includes an elongated hollow housing member and an elongated rod member mounted for reciprocal movement within the elongated hollow housing member. The elongated rod member has a first portion positioned within at least a portion of the elongated hollow housing member and a second portion extending out of an end of the elongated hollow housing. A jaw member may be provided which is engageable with this second portion of the elongated rod member at a location remote from the end of the elongated hollow housing member. The locking assembly comprises an end cap engageable with the end of the elongated hollow housing. This end cap includes a portion extending substantially parallel with the second portion of the elongated rod member. At least one aperture is formed through this parallel extending portion of the end cap. A means is provided which is engageable within this at least one aperture and with the second portion of the elongated rod member or the jaw member for preventing longitudinal movement of the elongated rod member with respect to the elongated hollow housing member and consequently for preventing the accidental let out of the slack adjuster. A groove may be provided within the second portion of the elongated rod member or the jaw member in a location which is substantially in alignment with the at least one aperture. Alternatively, a protrusion may be provided on the second portion of the elongated rod member or the jaw member in a location which is substantially in alignment with the at least one aperture. The means engageable within the aperture may be a locking means, such as a bolt or a screw, which extends through the aperture and into engagement with either the groove or the protrusion in a manner that allows the elongated rod member to be locked into position.

The locking assembly of the instant invention is particularly useful during shipping and handling of the slack adjuster for preventing unwanted let out of the slack adjuster and turning of the jaw member so as to facilitate installation of the slack adjuster into the brake rigging of the railway vehicle. Additionally, the locking assembly of the invention may be quickly and easily removed after installation of the slack adjuster.

Although a number of objects and advantages of the present invention have been described in some detail above, various additional objects and advantages of the locking assembly of the present invention will become more readily apparent to those persons who are skilled in the art from the following more detailed description of the invention, particularly, when such detailed description of the invention is taken in conjunction with both the attached drawing figures and with the appended claims.

DETAILED DESCRIPTION OF THE INVENTION

Figure 1:
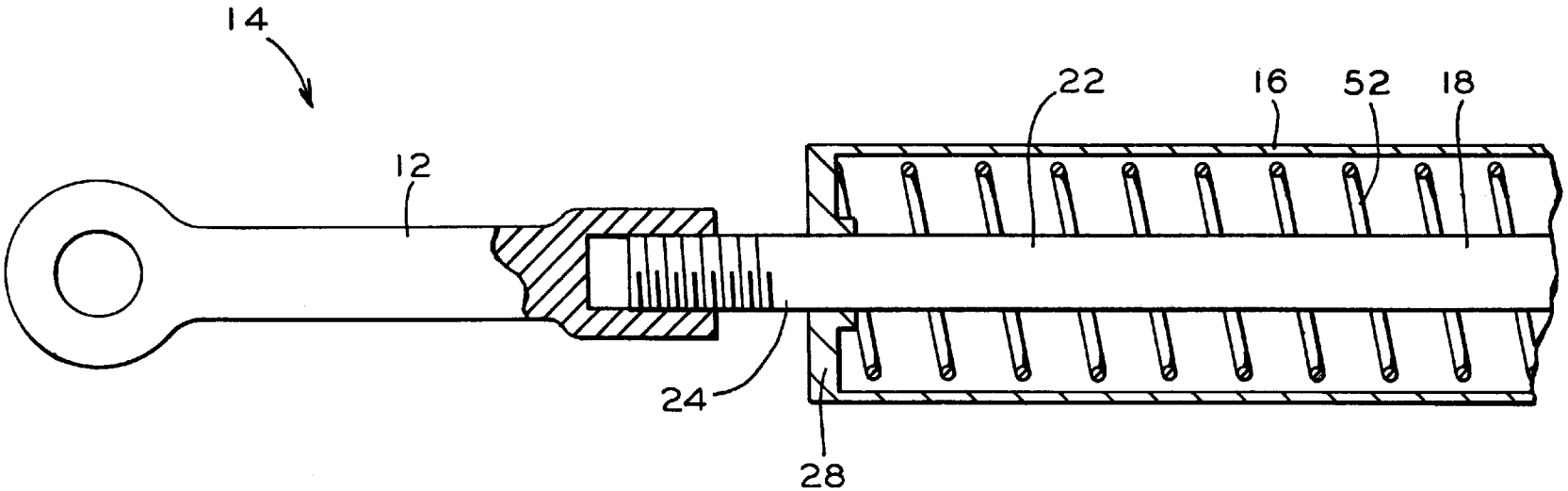
FIG. 1 PRIOR ART
FIG. 1 is a plan view of one type of a slack adjuster which is currently in use in railway vehicle brake assemblies.

Prior to proceeding with the more detailed description of the invention, it should be noted that for the sake of clarity, identical components which have identical functions have been identified with identical reference numerals throughout the several views illustrated in the attached drawing Figures.

Referring now to FIG. 1, there is shown an example of a double-acting compression actuatable slack adjuster, generally designated 14, which is currently in use in railway vehicle braking assemblies. The slack adjuster includes an elongated hollow housing member 16 and an elongated rod member 18 mounted for reciprocal movement within the elongated hollow housing member 16 and a spring 52 contained within the housing member 16. The elongated rod member 18 has a first portion 22 positioned within at least a portion of the elongated hollow housing member and a second portion 24 extending out of an end 28 of the elongated hollow housing 16 which is connectable to a rear jaw member 12 which is pivotally connectable with the brake rigging (not shown). The locking assembly of the invention is associated with this second portion 24 of the elongated rod member 18 in order to prevent longitudinal movement of the elongated rod member 18 with respect to the elongated hollow housing member 16 and consequently the accidental let out of the slack adjuster.

Referring now to FIGS. 2–4 and 5–7, there is shown the locking assembly, generally designated 10 and 100, respectively, of the invention. This locking assembly comprises an end cap 30 which is engageable with an end 28 of the elongated hollow housing 16. This end cap 30 includes a portion 32 extending substantially parallel with the second portion 24 of the elongated rod member 18. At least one aperture 34 is formed through this portion 32 of the end cap 30. A means 38, such as a locking means, is engageable within the at least one aperture 34 and with either the second portion 24 of the elongated rod member 18 or the rear jaw member 12.

Figure 2:
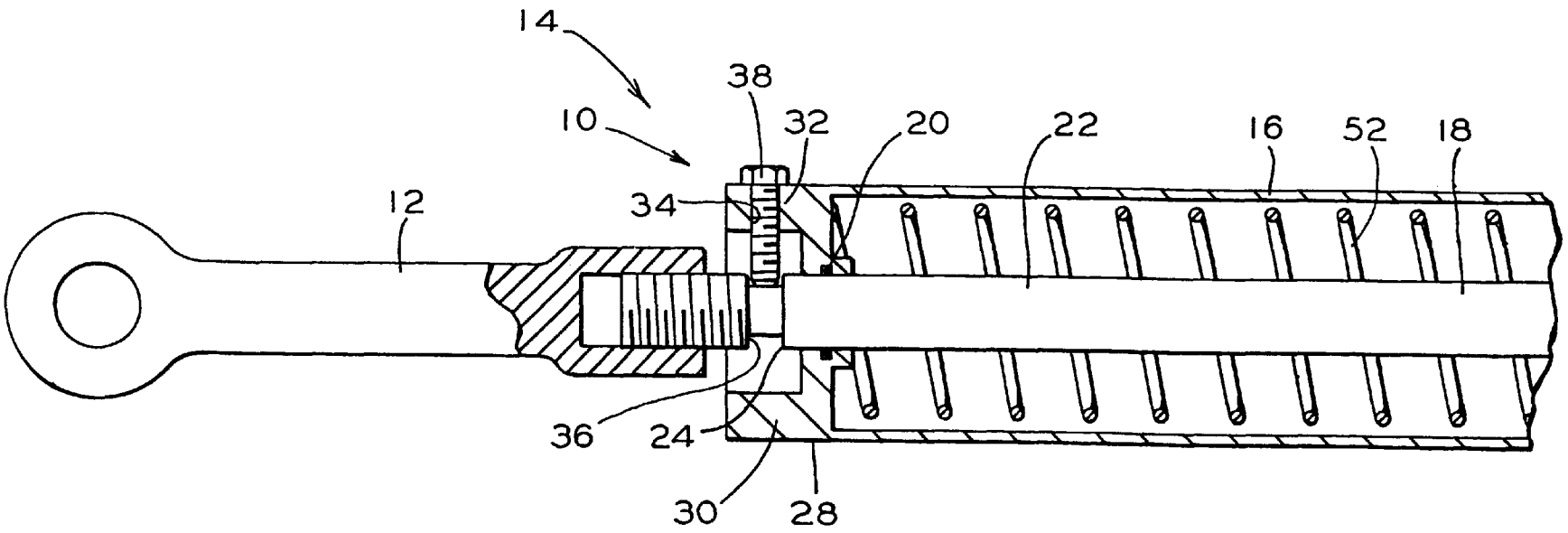
FIG. 2 is an exploded view of a portion of the slack adjuster illustrated in FIG. 1 including the inventive locking assembly wherein the locking means is engageable within a groove in one location in the elongated rod member.
Figure 3:
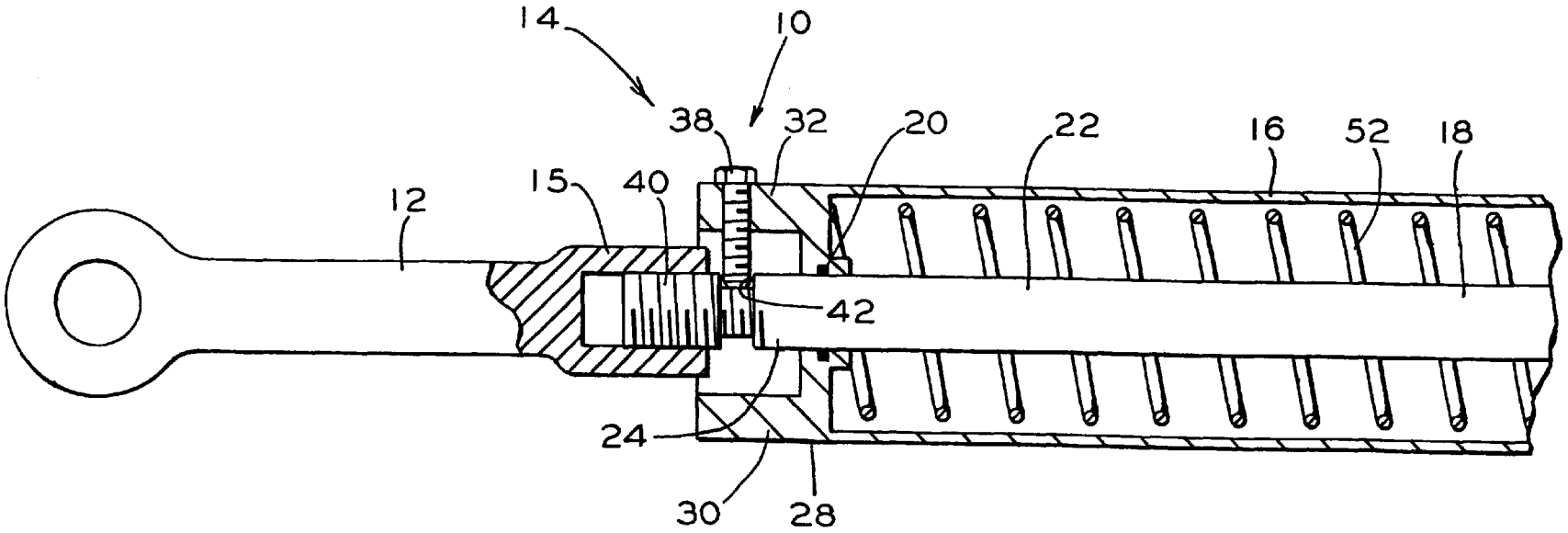
FIG. 3 is an exploded view of a portion of the slack adjuster illustrated in FIG. 1 including the inventive locking assembly wherein the locking means is engageable within a groove in another location in the elongated rod member.
Figure 4:
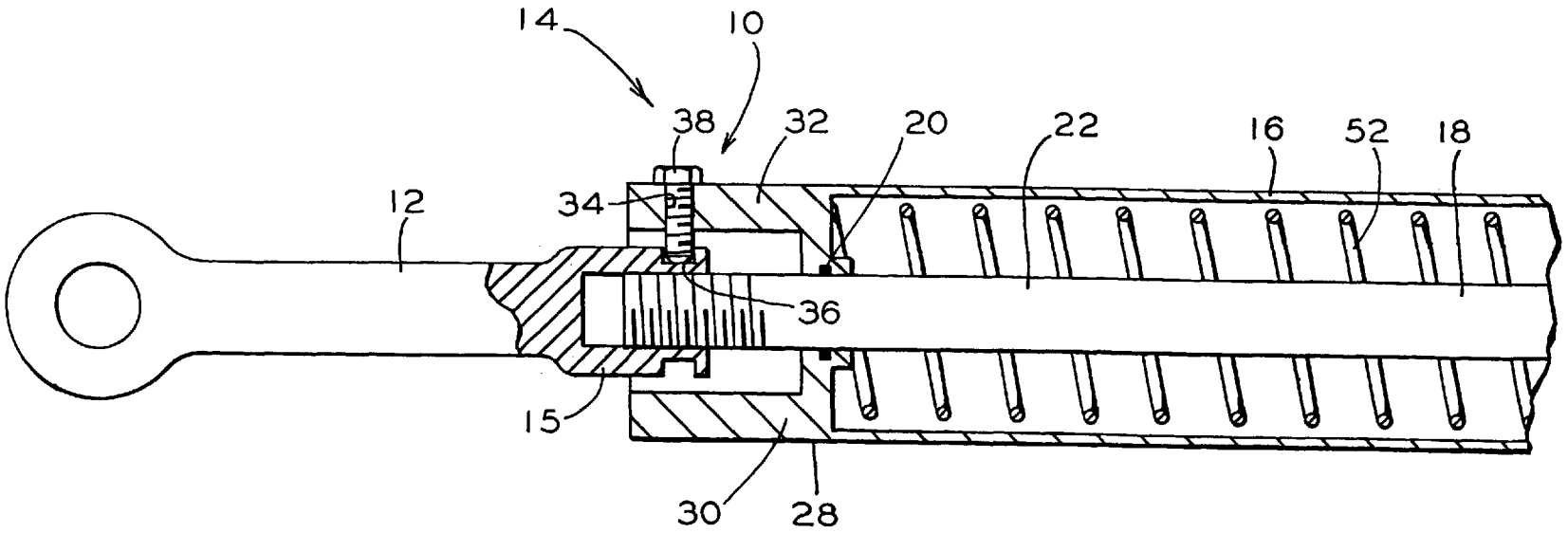
FIG. 4 is an exploded view of a portion of the slack adjuster illustrated in FIG. 1 including the inventive locking assembly wherein the locking means is engageable within a groove in the jaw member.

According to the embodiments illustrated in FIGS. 2–4, at least one groove 36 is formed within the second part 24 of the elongated rod member 18 or within the jaw member 12. This groove 36 is substantially in alignment with the at least one aperture 34 formed through the parallel extending portion 32 of the end cap 30. The groove 36 may extend substantially around the second part 24 of the elongated rod member 18 or substantially around the jaw member 12.

The locking means 38 provided is capable of extending through the at least one aperture 34 and into the at least one groove 36 for locking the elongated rod member 18 in position. Locking of the rod member 18 in position prevents the accidental let out of the slack adjuster during shipping and handling. Also, the locking assembly of the invention prevents turning of the jaw member 12 which is threadedly attached to the rod member 18.

The locking means 38 may be any well known attaching means which is capable of extending through the aperture 34 and into the corresponding groove 36. The locking means 38 is preferably a type which is capable of being readily removed at the time of installation of the slack adjuster 14. For example, the locking means 38 may be a screw member which is threadedly engageable within the aperture 34 and the groove 36. Alternatively, the locking means 38 may be a bolt which is mechanically fitted or frictionally held within the aperture 34 and the groove 36.

FIG. 2 shows placement of the groove 36 in the second part 24 of the elongated rod member 18. As illustrated in FIG. 3, this second part 24 of the elongated rod member 18 includes threads 40 thereon enabling a threaded engagement of the elongated rod member 18 with the jaw member 12. In this Figure, the at least one groove 36 is formed within a portion 42 of these threads 40 extending beyond the engagement of the elongated rod 18 with the jaw member 12. In FIG. 4, the portion 32 of the end cap 30 extends over a portion 15 of the rear jaw member 12. The at least one aperture 34 is provided in this portion 32 and the groove 36 is provided in the portion 15 of the jaw member 12 substantially in alignment with the aperture 34. The locking means 38 is then positioned within the aperture 34 and into the groove 36 for locking the jaw member 12, as well as the rod member 18 which is engageable with the jaw member 12, in position until installation of the slack adjuster into the braking system.

Figure 5:
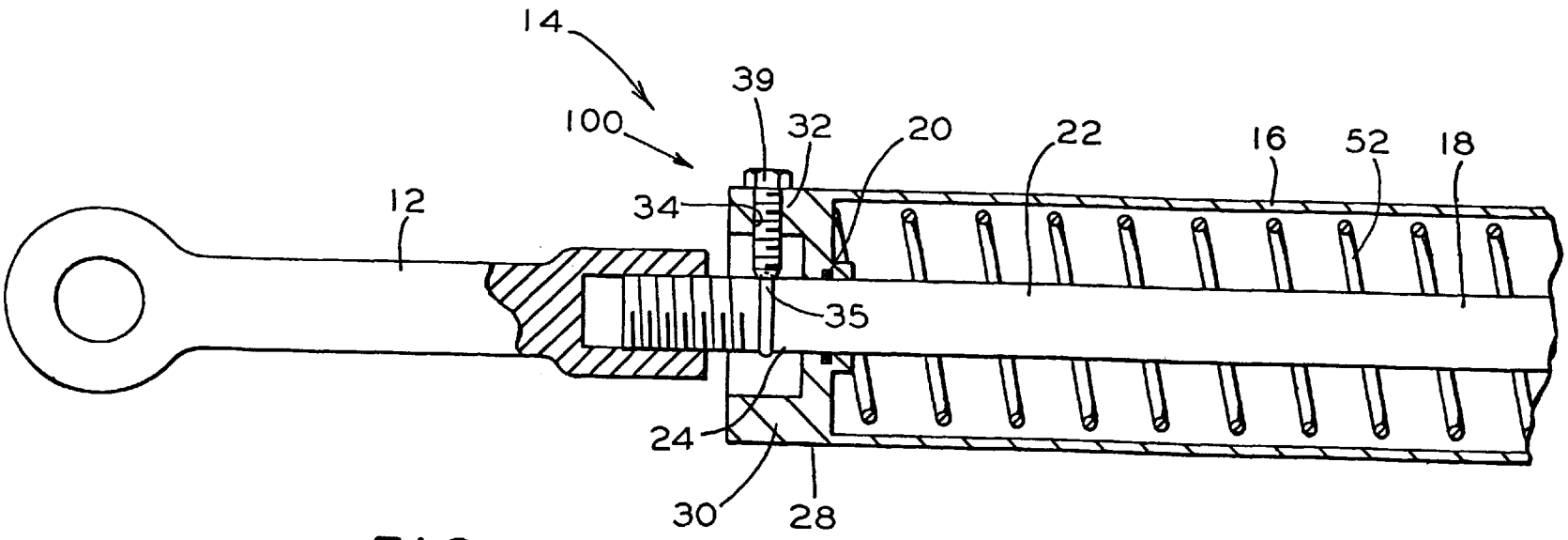
FIG. 5 is an exploded view of a portion of the slack adjuster illustrated in FIG. 1 including the inventive locking assembly wherein the locking means is engageable with a protrusion at one location on the elongated rod member.
Figure 6:
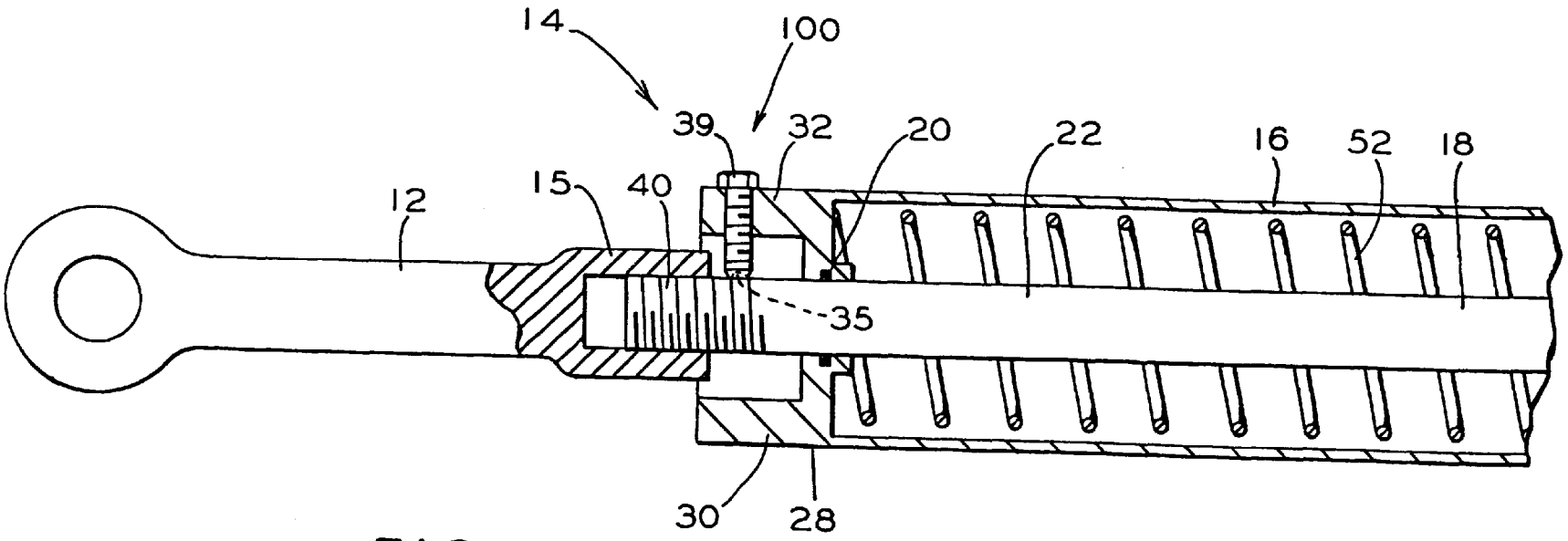
FIG. 6 is an exploded view of a portion of the slack adjuster illustrated in FIG. 1 including the inventive locking assembly wherein the locking means is engageable with a protrusion at another location on the elongated rod member.
Figure 7:
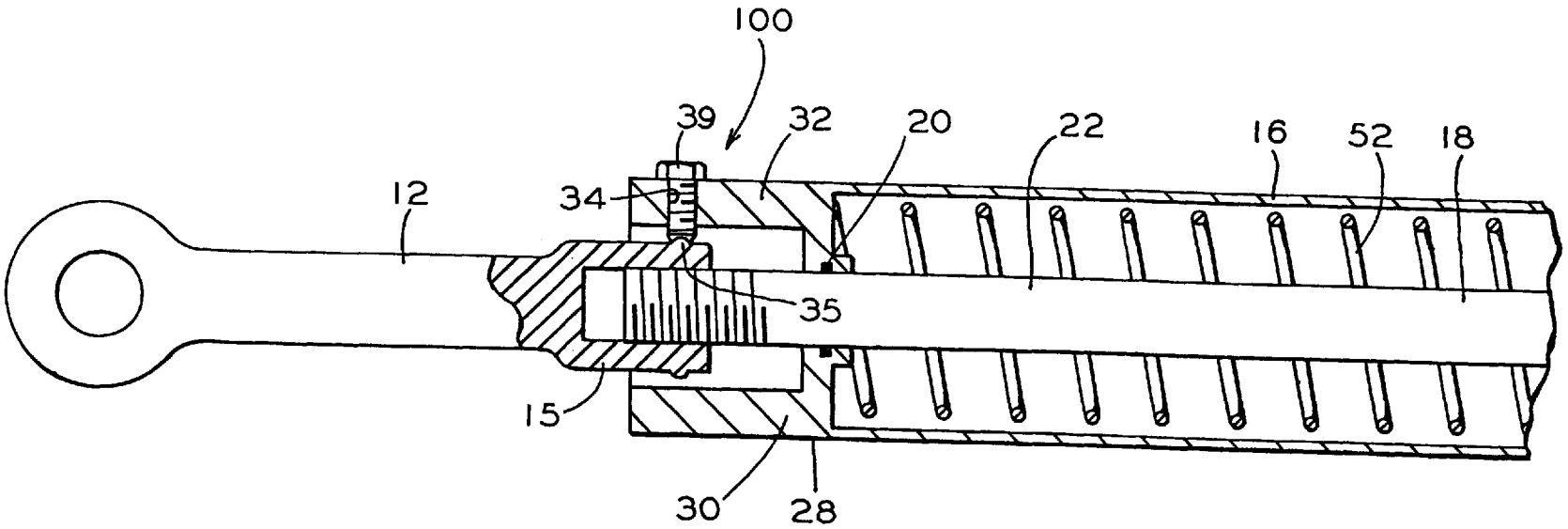
FIG. 7 is an exploded view of a portion of the slack adjuster illustrated in FIG. 1 including the inventive locking assembly wherein the locking means is engageable with a protrusion on the jaw member.

The embodiments illustrated in FIGS. 5–7 differ from those shown in FIGS. 2–4 in that instead of a groove being formed in the second portion 24 of the elongated rod member 18 or the jaw member 12, a protrusion 35 is provided on the surface of the second portion 24 of the elongated rod member 18 or the jaw member 12. This protrusion 35 is substantially in alignment with the at least one aperture 34 formed through the portion of the end cap and engageable with the means 39 engageable within the at least one aperture 34. The means engageable with the at least one aperture comprises a locking means 39 which is capable of extending through the aperture 34. This locking means 39 includes a hollow portion at one end which is capable of matingly engaging with the protrusion 35 for locking the elongated rod member 18 in position. This protrusion 35 may be located on the elongated rod member 18 (FIG. 5), on threads 40 which enable a threaded engagement of the elongated rod member 18 with the jaw member 12 (FIG. 6), and/or the rear jaw member 12 (FIG. 7).

Thus, the present invention has been described in such full, clear, concise and exact terms as to enable any person skilled in the art to which it pertains to make and use the same. It will be understood that variations, modifications, equivalents, and substitutions for components of the specifically described embodiments of the invention may be made by those skilled in the art without departing from the spirit and scope of the invention as set forth in the appended claims.

We claim:

1. A locking assembly for preventing the accidental let out of a slack adjuster, said slack adjuster including an elongated hollow housing member and an elongated rod member mounted for reciprocal movement within such elongated hollow housing member, such elongated rod member having a first portion positioned within at least a portion of such elongated hollow housing member and a second portion extending out of an end of such elongated hollow housing, said locking assembly comprising:

(a) an end cap engageable with such end of such elongated hollow housing, said end cap including a portion extending substantially parallel with such second portion of such elongated rod member;

(b) at least one aperture formed through said portion of said end cap; and (c) means engageable within said at least one aperture and with such second portion of such elongated rod member for preventing longitudinal movement of such elongated rod member with respect to such elongated hollow housing member and for preventing the accidental let out of such slack adjuster.

2. A locking assembly as recited in claim 1 including at least one groove formed within such second portion of such elongated rod member, said at least one groove being substantially in alignment with said at least one aperture formed through said portion of said end cap and engageable with said means engageable within said at least one aperture.

3. A locking assembly as recited in claim 2 wherein said means engageable with said at least one aperture comprises a locking means capable of extending through said aperture and into said at least one groove for locking such elongated rod member in position.

4. A locking assembly as recited in claim 3 wherein said locking means comprises one of a screw and a threaded bolt and said aperture is threaded for receiving one of said screw and threaded bolt.

5. A locking assembly as recited in claim 3 wherein said locking means is capable of frictionally fitting within said aperture.

6. A locking assembly as recited in claim 2 wherein said groove extends substantially around such second portion of such elongated rod member.

7. A locking assembly as recited in claim 1 including at least one protrusion formed on such second portion of such elongated rod member, said at least one protrusion being substantially in alignment with said at least one aperture formed through said portion of said end cap and engageable with said means engageable within said at least one aperture.

8. A locking assembly as recited in claim 7 wherein said means engageable with said at least one aperture comprises a locking means capable of extending through said aperture, said locking means including a hollow portion at one end capable of matingly engaging said protrusion for locking such elongated rod member in position.

9. A locking assembly as recited in claim 1 wherein such second portion of such elongated rod member includes a jaw member engageable therewith.

10. A locking assembly as recited in claim 9 wherein such second portion of such elongated rod member includes threads thereon enabling a threaded engagement of such elongated rod member with said jaw member and at least one of a groove and a protrusion is formed within a portion of said threads extending beyond said engagement with said jaw member, said at least one of a groove and protrusion being substantially in alignment with said at least one aperture formed through said portion of said end cap and engageable with said means engageable within said at least one aperture.

11. A locking assembly as recited in claim 1 wherein said means engageable within said at least one aperture and with such second portion of such elongated rod member is capable of being removed at the time of installation of such slack adjuster.

12. A locking assembly for preventing the accidental let out of a slack adjuster, said slack adjuster including an elongated hollow housing member, an elongated rod member mounted for reciprocal movement within such elongated hollow housing member, such elongated rod member having a first portion positioned within at least a portion of such elongated hollow housing member and a second portion extending out of an end of such elongated hollow housing, and a jaw member engageable with such second portion of such elongated rod member at a location remote from such end of such elongated hollow housing member, said locking assembly comprising:

(a) an end cap engageable with such end of such elongated hollow housing, said end cap including a portion extending substantially parallel with such second portion of such elongated rod member and at least a portion of such jaw member;

(b) at least one aperture formed through said portion of said end cap; and (c) means engageable within said at least one aperture and with such jaw member for preventing longitudinal movement of such elongated rod member with respect to such elongated hollow housing member and for preventing the accidental let out of such slack adjuster.

13. A locking assembly as recited in claim 12 including at least one groove formed within such portion of such jaw member, said at least one groove being substantially in alignment with said at least one aperture formed through said portion of said end cap and engageable with said means engageable within said at least one aperture.

14. A locking assembly as recited in claim 13 wherein said means engageable with said at least one aperture comprises a locking means capable of extending through said aperture and into said at least one groove for locking such elongated rod member in position and preventing the accidental let out of such slack adjuster.

15. A locking assembly as recited in claim 14 wherein said locking means comprises one of a screw and threaded bolt and said aperture is threaded for receiving one of said screw and threaded bolt.

16. A locking assembly as recited in claim 14 wherein said locking means is capable of frictionally fitting within said aperture.

17. A locking assembly as recited in claim 13 wherein said groove extends substantially around such portion of such jaw member.

18. A locking assembly as recited in claim 12 including at least one protrusion formed on such portion of such jaw member, said at least one protrusion being substantially in alignment with said at least one aperture formed through said portion of said end cap and engageable with said means engageable within said at least one aperture.

19. A locking assembly as recited in claim 18 wherein said means engageable with said at least one aperture comprises a locking means capable of extending through said aperture, said locking means including a hollow portion at one end capable of matingly engaging said protrusion for locking such elongated rod member in position.

20. A locking assembly as recited in claim 12 wherein said means engageable within said at least one aperture and with such jaw member is capable of being removed at the time of installation of such slack adjuster.

* * * * *